US006115478A

United States Patent [19]

Schneider

[11] Patent Number: 6,115,478

[45] Date of Patent: Sep. 5, 2000

[54] APPARATUS FOR AND METHOD OF PROGRAMMING A DIGITAL HEARING AID

[75] Inventor: Anthony Todd Schneider, Waterloo, Canada

[73] Assignee: dspfactory Ltd., Waterloo, Canada

[21] Appl. No.: 09/060,820

[22] Filed: Apr. 16, 1998

Related U.S. Application Data

[60] Provisional application No. 60/041,975, Apr. 16, 1997.

[51] Int. Cl.[7] ..... H04R 25/00

[52] U.S. Cl. ..... 381/314; 381/312; 381/315; 381/320; 73/585

[58] Field of Search ..... 381/71.12, 71.13, 381/71.14, 77, 78, 80, 312, 314, 315, 320, 321, 323, 60; 73/585

[56] References Cited

U.S. PATENT DOCUMENTS

| | | | |
|---|---|---|---|
| 4,689,820 | 8/1987 | Kopke et al. | 381/68 |
| 4,790,019 | 12/1988 | Hueber | 381/68.4 |
| 4,852,175 | 7/1989 | Kates | 381/71 |
| 4,918,736 | 4/1990 | Bordewijk | 381/68 |
| 5,083,312 | 1/1992 | Newton et al. | 381/68.4 |
| 5,172,346 | 12/1992 | Wagner et al. | 367/197 |
| 5,226,086 | 7/1993 | Platt | 381/58 |
| 5,233,665 | 8/1993 | Vaughn et al. | 381/97 |
| 5,604,812 | 2/1997 | Meyer | 381/68.2 |
| 5,636,285 | 6/1997 | Sauer | 381/68.2 |
| 5,910,997 | 6/1999 | Ishige | 381/314 |

FOREIGN PATENT DOCUMENTS 671 131 7/1989 Switzerland .

*Primary Examiner*—Stella Woo
*Assistant Examiner*—Suhan Ni
*Attorney, Agent, or Firm*—Bereskin & Parr

[57] ABSTRACT

A method is provided for programming a digital hearing aid using a program encoded in an audio band (20 Hz–20 kHz) signal, to transmit and verify programs and algorithm parameters. Preferably, this is in a digital hearing aid including filterbanks, filtering the audio signal into different frequency bands. The signal is encoded by the presence and absence of a signal in each frequency band or by other well-known modulation techniques used by computer modems. Special programming signals are provided alternating between the frequency bands in a manner to clearly distinguish the program data from any other interfering or normally present audio signal. The method does not require additional hardware, and offers reduced power consumption, as compared to some known wireless programming interfaces. It enables remote programming over a network using standard multimedia computer hardware.

23 Claims, 2 Drawing Sheets

APPARATUS FOR AND METHOD OF PROGRAMMING A DIGITAL HEARING AID

CROSS-REFERENCE TO RELATED APPLICATION

This application claims benefit from U.S. provisional application Ser. No. 60/041,975 filed on Apr. 16, 1997.

FIELD OF THE INVENTION

This invention relates to hearing aids. This invention more particularly relates to a method of programming a software-programmable, digital hearing aid and to such a hearing aid, and even more particularly relates to a programmable digital hearing aid including a filterbank processing architecture.

BACKGROUND OF THE INVENTION

Programmable analog hearing aids have been in use for a number of years. These hearing aids allow precise adjustment of the specific parameters of a hearing aid processing scheme to achieve a reasonably good "fit" for the hearing aid user. Programmable digital hearing aids extend this capability by also allowing new programs to be downloaded. The ability to load a new program on a digital hearing aid means that entirely different processing schemes can be implemented simply by downloading new software.

Hearing aids have traditionally been programmed with wired links that sometimes connect to a body worn programming interface that in turn incorporates a wired or wireless link to the hearing aid programmer. The use of a wired link means that a hearing aid must incorporate a connector for the programming cable. Typical programming interfaces use serial data transmission with between two and four electrical connections depending on whether the serial connection is transmit and receive or receive-only. Newer connection schemes that do not require a separate programming connector have recently been developed. They use the battery terminals to supply power and transmit data to the hearing aid. This approach sometimes requires that additional battery contacts be added, depending on the nature of the serial interface. All of these programming methods require special programming cables and small connectors that are expensive and prone to breakage.

Other programming interfaces that have been used successfully are infrared or ultrasonic links. All of these approaches require additional circuitry increasing costs and power consumption and the space occupied within the hearing aid. For digital hearing aid programming, ultrasonic links are not practical because of the high sampling rate required to convert and ultrasonic signal into a digital representation. Although they are often used to transmit data between programming interfaces and personal computers, infrared links have never been widely used on hearing aids because of their higher power consumption, susceptibility to interference and undesirable directional characteristics. Thus, the majority of current digital hearing aids rely on wired programming links which require a specialized connector and programming cable.

An important consideration for all programming interfaces is safety. It is often desirable to have the user wear the hearing aid while it is being programmed, so that the "fit" between the new program and the user's hearing deficiency can be immediately checked. If the user is wearing the hearing aid while it is being programmed, there must be electrical isolation between the hearing aid wearer and the programming system, especially if the programming system is connected to line voltage (120 volts or higher). Many systems use isolated power supplies or battery power and supply all signals to the hearing aid wearer through optoisolators. Wireless systems overcome the problems if isolation from line voltage, but may require optoisolators even if a battery powered, body-worn programming interface is used.

SUMMARY OF THE INVENTION

This invention incorporates a scheme for programming and programming verification in a programmable digital filterbank hearing aid that uses an existing filterbank and specially synthesized signals in the audio band (20 Hz to 20 kHz) to change and verify hearing aid parameters or download and verify a new hearing aid program. A digital filterbank hearing aid processes a digital representation of an input signal using an analysis filterbank that separates the input signal into a plurality of separate frequency bands. These bands are processed separately of in combination and then recombined via a synthesis filterbank to form a digital, time-domain representation output signal. Because an existing filterbank and programming digital signal processor are used to detect the presence, absence and transitions of the audio-band programming signals and decode the information they contain, no additional hardware is required.

Other advantages of the method and apparatus of the present invention are: the audio programming signals employed can be synthesized and delivered by standard multimedia computer hardware, for example a PC (Personal Computer) with a sound card and speakers or headphones; the invention supports remote programming of digital hearing aids over computer networks; the audio-band programming signals can be pre-synthesized and transmitted over a network or synthesized locally and delivered using standard multimedia computer hardware, for example a PC with a sound card and speakers or headphones; the invention enables a wide variety of audio-band programming signals to be used; for example, audio signals generated by standard computer modem modulation techniques may be used or dual-tone multi-frequency (DTMF) tones similar to those used by telephones to transmit key presses may be used; the invention provides a high degree of safety comparable to other wireless links because the hearing aid wearer is electrically isolated from the programming system by an acoustic channel.

A number of modulation techniques that are used for computer modem and RF applications could also be used to transmit data to the digital hearing aid via an audio signal. For example, a technique similar to spread spectrum, where the input data stream is modulated with an audio-band maximum length sequence could be used. This technique would be very resistant to background noise. Standard modulation/demodulation techniques like quadrature phase shift keying (PSK), differential PSK (DPSK) and quadrature amplitude modulation (QAM) could also be used. These techniques are widely used in computer modems-DPSK is standardized in V.22 and V.22 bis modems. QAM is a coherent modulation technique that is well-suited for transmission of digital information over high-quality, band-limited communication paths. Using any of these techniques would require that the hearing aid be software programmed to operate as a modem. Such techniques are disclosed in: "Real-time DSP Modems with a PC and Sound Card," Circuit Cellar INK: The Computer Applications Journal, Issue 76, pp. 21–29, November 1996, by M. Park and B. McLeod, the contents of which are hereby incorporated by reference.

In accordance with the present invention, there is provided a method of processing an audio band signal in a digital hearing aid, said hearing aid comprising a microphone, an analysis filterbank having a plurality of separate frequency band outputs, a programmable digital signal processor, a non-volatile memory, and a receiver, the method comprising the steps of:

(1) programming an encoding scheme in said digital signal processor;

(2) receiving said audio band signal at said microphone;

(3) converting said audio band signal into a digital signal;

(4) in said analysis filterbank, seperating said digital signal into a plurality of separate frequency band signals each being representative of a specific frequency band;

(5) providing said frequency band signals to said digital signal processor;

(6) determining whether said separate frequency band signals have programming information encoded therein according to said encoding scheme; and (7) if programming information is encoded in said frequency band signals according to said encoding scheme, decoding said frequency band signals to obtain said programming information and storing said programming information in said non-volatile memory.

Preferably, the method further includes a step of:

(8) if programming information is not encoded in said frequency band signals according to said encoding scheme, processing said frequency band signals according to programming information stored in said hearing aid to provide a processed audio band output signal at said receiver. Also, preferably, a step of synthesizing programming information into an audio band programming signal and transmitting the audio band programming signal to said hearing aid is further included.

For this purpose, the program can be encoded into the band structure by providing a signal in alternate bands with no signal being present in bands between said alternate bands. Advantageously, the bands then comprise alternating even numbered bands and odd numbered bands, and logic level one is encoded as a signal in one of the even numbered bands and the odd numbered bands and logic level zero is encoded as a signal in the other of the even numbered bands and odd numbered bands.

After the hearing aid receives and decodes a program, the hearing aid preferably generates a verification signal that is transmitted through the receiver thereof and which is received by the hearing aid programmer, to verify the correctness of the program data received by the hearing aid.

Conveniently, the programming signals are transmitted over a network, selected from one of a local area network, a wide area network or a modem link, and program data is synthesised into an audio-band programming signal locally and acoustically transmitted to the hearing aid. The programming data can be received by a multimedia computer in text format, binary format or other format, and synthesised locally into the audio band signal. Alternatively, the audio band signal is pre-synthesised by a computer and transmitted over a computer network to a hearing aid program system, and the programming data is decoded and acoustically reproduced for programming the hearing aid.

The method can be carried out either:

(1) with the hearing aid worn by a user to enable immediate verification of the suitability of the program for the user; or (2) by placing the hearing aid in a sound chamber and connecting the hearing aid to a coupler simulating the characteristics of the human ear canal, whereby the programming signal can be transmitted acoustically to the hearing aid, isolated from any interfering audio signal.

Another aspect of the present invention provides a digital hearing aid comprising:

(a) a microphone for receiving an audio band signal;

(b) an A/D converter for converting said audio band signal into a digital signal;

(c) an analysis filterbank for separating said digital signal into a plurality of separate frequency band signals each being representative of a specific frequency band;

(d) a programmable digital signal processor for receiving said frequency band signals and being programmed to determine whether said separate frequency band signals have programming information encoded therein according to an encoding scheme;

(e) a non-volatile memory for storing programming information, wherein, when programming information is encoded in said frequency band signals, said digital signal processor decodes said frequency band signals and stores said programming information in said memory;

(f) a synthesis filterbank for combining said processed frequency band signals into a processed digital signal; and (g) a D/A converter and receiver for converting said processed digital signal into a processed audio band output signal.

In a further aspect, the method of the present invention can comprise programming a digital hearing aid having two separate inputs, and the method comprises encoding the program into two separate audio band signals and transmitting one audio band signal to one input and the other audio band signal to the other input.

BRIEF DESCRIPTION OF THE DRAWING FIGURES

For a better understanding of the present invention and to show more clearly how it may be carried into effect, reference will no be made, by way of example, to the accompanying drawings, in which.

DESCRIPTION OF THE PREFERRED EMBODIMENT

Figure 1:
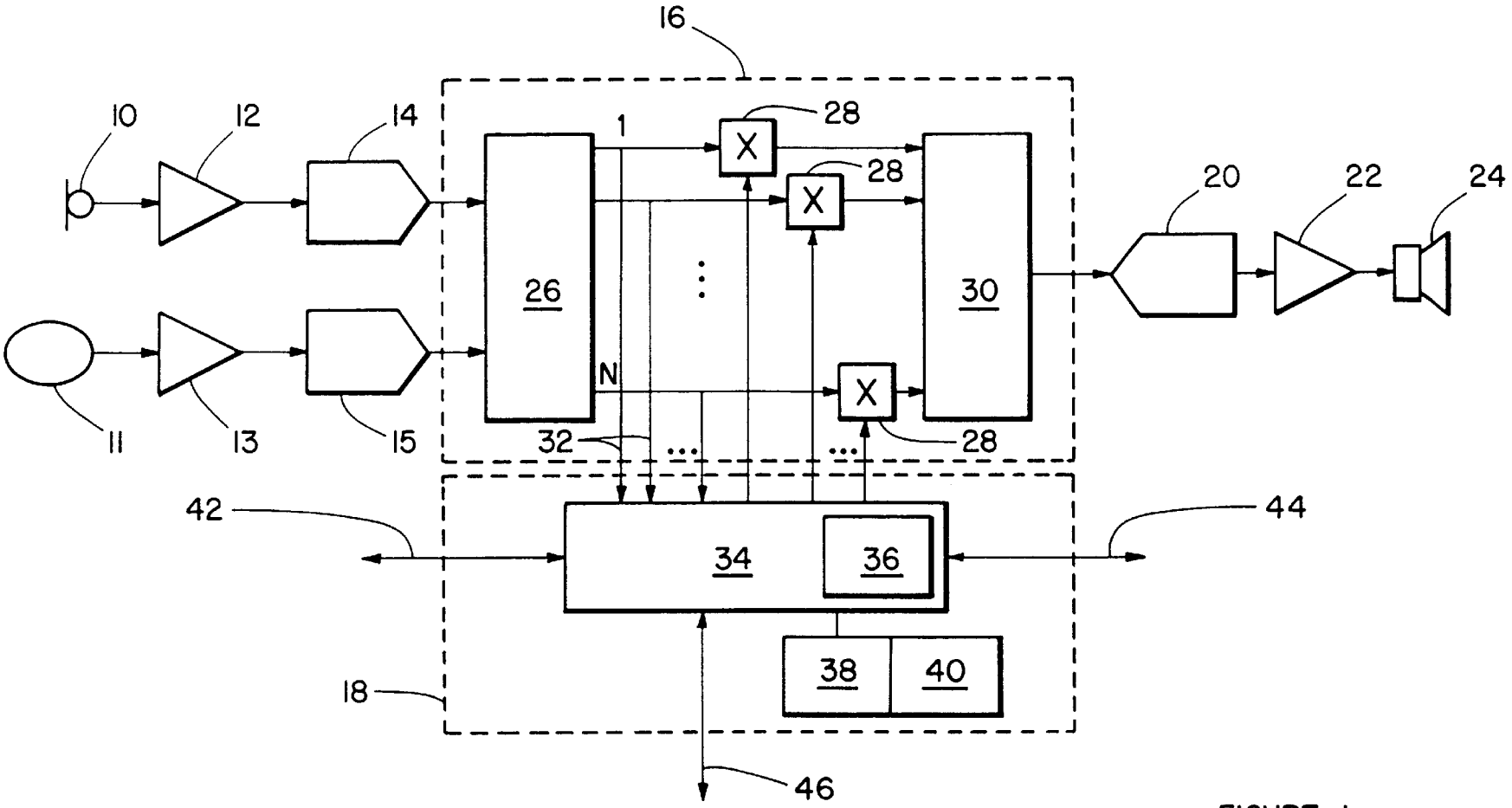
FIG. 1 shows a preferred embodiment of the present invention, and schematically a block diagram of an ASIC data path processor and programmable digital signal processor in accordance with the present invention.

With reference to FIG. 1 the apparatus of the present invention has a microphone 10, as a first input connected to a preamplifier 12, which in turn is connected to an analog-to-digital, (A/D) converter 14. In known manner this enables an acoustic, audio-band signal, for example, to be received in the microphone, preamplified and converted to a digital representation in the A/D converter 14. A secondary input 11 (which may also comprise a microphone) may also be connected to a preamplifier 13 which is in turn connected to an analog-to-digital (A/D) converter 15. Thus the present invention is embodiable with both monaural applications (i.e. one digital stream) and stereo applications (i.e. two digital streams). The output of the A/D converter 14 (and where a secondary input exists, the output of the secondary A/D converter 15) is connected to a filterbank application specific integrated circuit (ASIC) 16 as shown in FIG. 1 or, alternatively, directly to a programable digital signal processor (DSP) unit 18 via a synchronous serial port. Additional A/D converters (not shown) may be provided to permit digital processing of multiple separate input signals. Further input signals (not shown) may be mixed together in the analog domain prior to conversion by these A/D converters or, alternatively, in the digital domain by the programmable DSP unit 18. The filterbank ASIC 16 is capable of processing one (monaural) or two (stereo) digital streams, as described in co-pending application Ser. No. 09/060,823. The output of the filterbank ASIC 16 is connected to a digital-to-analog (D/A) converter 20. The converter 20 is in turn connected through a power amplifier 22 to a hearing aid receiver 24. Thus, the filtered signal, in known manner, is converted back to an analog signal, amplified and applied to the receiver 24.

The output of the A/D converter 14, and any additional A/D converter that is provided, may, instead of being connected to the ASIC 16 as shown, be connected to the programmable DSP 18 via a synchronous serial port. Similarly, the output D/A converter 20 can alternatively be connected to the programmable DSP 18.

Within the filterbank ASIC 16, there is an analysis filterbank 26, that splits or divides the digital representation of the input signal or signals into a plurality of separate complex bands, represented by the signals 1-N. As shown in FIG. 1, each of these band signals or outputs is multiplied by a desired gain in a respective multiplier 28. In the case of monaural processing, the negative frequency band signals are complex conjugate versions of the positive frequency band signals. As a result, the negative frequency bands are implicitly known and need not be processed. The outputs of the multipliers 28 are then connected to inputs of a synthesis filterbank 30 in which these outputs are recombined to form a complete digital representation of the signal.

For stereo processing, the complex conjugate symmetry property does not hold. In this case, the N band signals or outputs are unique and represent the frequency content of two real signals. The band outputs must first be processed to separate the content of the two signals from each other into two frequency domain signals before the gain multiplication step is performed. The two frequency separated signals are complex conjugate symmetric and obey the same redundancy properties as described previously for monaural processing. Multiplier resource 28 must, therefore, perform two sets of gain multiplications for the non-redundant (i.e. positive frequency) portion of each signal. After multiplication, the signals are combined into a monaural signal, and further processing is identical to the monaural case.

In known manner, to reduce the data and processing requirements, the band outputs from the analysis filterbank 26 are down-sampled or decimated. Theoretically, it is possible to preserve the signal information content with a decimation factor as high as N, corresponding to critical sampling at the Nyquist rate. However, it was found that maximum decimation, although easing computational requirements, created severe aliasing distortion if adjacent band gains differ greatly. Since this distortion unacceptably corrupts the input signal, a lesser amount of decimation was used. In a preferred embodiment, the band outputs are oversampled by a factor OS times the theoretical minimum sampling rate. The factor OS represents a compromise or trade-off, with larger values providing less distortion at the expense of greater processing requirements. Preferably, the factor OS is made a programmable parameter by the DSP.

To reduce computation, a time folding structure can be used as disclosed in a copending and simultaneously filed application Ser. No. 09/060,823 entitled "Filterbank Structure and Method for Filtering and Separating an Audio Signal into Different Bands, particularly for Hearing Aids", in the names of Robert Brennan and Anthony Todd Schneider.

As indicated at 32, connections to a programmable DSP 18 are provided, to enable the DSP to implement a particular processing strategy. The programmable DSP 18 comprises a processor module 34 including a volatile memory 36. The processor 34 is additionally connected to a nonvolatile memory 38 which is provided with a charge pump 40.

As detailed below, various communication ports are provided, namely: a 16 bit input/output port 42, a synchronous serial port 44 and a programming interface link 46.

The band signals received by the DSP 18 are representative of the different bands and are used by the digital signal processor 34 to determine gain adjustments, so that a desired processing strategy can be implemented. The gains are computed based on the input signal characteristics and then supplied to the multipliers 28. While individual multipliers 28 are shown, in practice, as already indicated these could be replaced by one or more multiplier resources shared amongst the filterbank bands. This can be advantageous, as it reduces the amount of processing required by the DSP, by reducing the gain update rate and by allowing further computations to be done by the more efficient ASIC. In this manner, battery life can be extended because the DSP unit 18 can conserve power by remaining in a low-power standby mode for a longer period of time.

The processor 34 can be such as to determine when gain adjustments are required. When gain adjustments are not required, the whole programmable DSP unit 18 can be switched into a low-power or standby mode, so as to reduce power consumption and hence to extend battery life.

In another variant of the invention, not shown, the multipliers 28 are omitted from the ASIC. The outputs from the analysis filterbank 26 would then be supplied to the digital signal processor 34, which would both calculate the gains required and apply them to the signals for the different bands. The thus modified band signals would then be fed back to the ASIC and then to the synthesis filterbank 30. This would be achieved by a shared memory interface, which is described below.

Communication between the ASIC 16 and the programmable DSP 18 is preferably provided by a shared memory interface. The ASIC 16 and the DSP 18 may simultaneously access the shared memory, with the only constraint being that both devices cannot simultaneously write to the same location of memory.

Both the ASIC 16 and programmable DSP 18 require non-volatile memory for storage of filter coefficients, algorithm parameters and programs as indicated at 38. The memory 38 can be either electrically erasable programmable read only memory (EEPROM) or Flash memory that can be read from or written to by the processor 34 as required. Because it is very difficult to achieve reliable operation for large banks (e.g., 8 kbyte) of EEPROM or Flash memory at low supply voltages (1 volt), the charge-pump 40 is provided to increase the non-volatile memory supply voltage whenever it is necessary to read from or write to non-volatile memory. Typically, the non-volatile memory 38 and its associated charge pump 40 will be enabled only when the whole apparatus or hearing aid "boots"; after this it will be disabled (powered down) to reduce power consumption.

Program and parameter information may also be transmitted to the digital signal processor 34 over the bi-directional programming interface link 46 that connects it to a programming interface.

This interface receives programs and parameter information from a personal computer or dedicated programmer over a bi-directional wired or wireless link. It will be appreciated that the term program may generally comprise executable code, which once processed by the hearing aid may be discarded. When connected to a wired programming interface, power for non-volatile memory is supplied by the interface; this will further increase the lifetime of the hearing aid battery. A specially synthesized audio band signal can also be used to program the digital filterbank hearing aid.

The synchronous serial port 44 is provided on the DSP unit 18 so that an additional analog-to-digital converter can be incorporated for processing schemes that require two input channels (e.g., beamforming—beamforming is a technique in the hearing aid art enabling a hearing aid with at least two microphones to focus in on a particular sound source).

The programmable digital signal processor 34 also provides a flexible method for connecting and querying user controls. A 16-bit wide parallel port is provided for the interconnection of user controls such as switches, volume controls (shaft encoder type) and for future expansion. Having these resources under software control of the DSP unit 18 provides flexibility that would not be possible with a hardwired ASIC implementation.

It is essential to ensure the reliability of the digital filterbank hearing aid in difficult operating environments. Thus, error checking or error checking and correction can be used on data stored in non-volatile memory. Whenever it is powered on, the hearing aid will also perform a self-test of volatile memory and check the signal path by applying a digital input signal and verifying that the expected output signal is generated. Finally, a watchdog timer is used to ensure system stability. At a predetermined rate, this timer generates an interrupt that must be serviced or the entire system will be reset. In the event that the system must be reset, the digital filterbank hearing aid produces an audible indication to warn the user.

A number of sub-band coded (i.e., digitally compressed) audio signals can be stored in the non-volatile memory 38 and transferred to volatile memory (RAM) 36 for real-time playback to the hearing aid user. The sub-band coding can be as described in chapters 11 and 12 of Jayant, N. S. and Noll, P., Digital Coding of Waveforms (Prentice-Hall; 1984) which is incorporated herein by this reference. These signals are used to provide an audible indication of hearing aid operation. Sub-band coding of the audio signals reduces the storage (non-volatile memory) that is required and it makes efficient use of the existing synthesis filterbank and programmable DSP because they are used as the sub-band signal decoder.

Now, in accordance with the present invention, to program the hearing aid, the audio-band signals used for the transmission of programs and parameter information are designed to generate patterns of levels on the outputs of the analysis filterbank 26 in such a manner that it is highly improbable the patterns will be confused with patterns generated by any other naturally present or interfering audio signals, that may be encountered in everyday environments. The programming and parameter information is encoded in the presence, absence and transitions of these patterns. These states (presence, absence and transitions) are detected on the filterbank output by the programmable DSP 34 and decoded to extract the programming and parameter information. An example of a suitable signal is given below.

During normal operation, the programmable DSP 34 monitors the output levels of the filterbank channels and detects the presence, absence and transitions of the special programming signals. In the absence of these special patterns, the hearing aid will operate normally. The hearing aid will enter programming mode if a specific pattern of these states is detected on the analysis filterbank outputs. Once the digital filterbank hearing aid is in programming mode, it will continue to receive encoded data that is transmitted as the presence, absence and transitions of the special programming signals until it has received a specific pattern of these states that terminate programming or there has been no detection of the special programming signals for a predetermined length of time.

The hearing aid provides verification that the encoded data has been correctly received and detected by transmitting an audio signal through the hearing aid receiver 24. This audio signal encodes that data that was received and decoded by the hearing aid.

Figure 2:
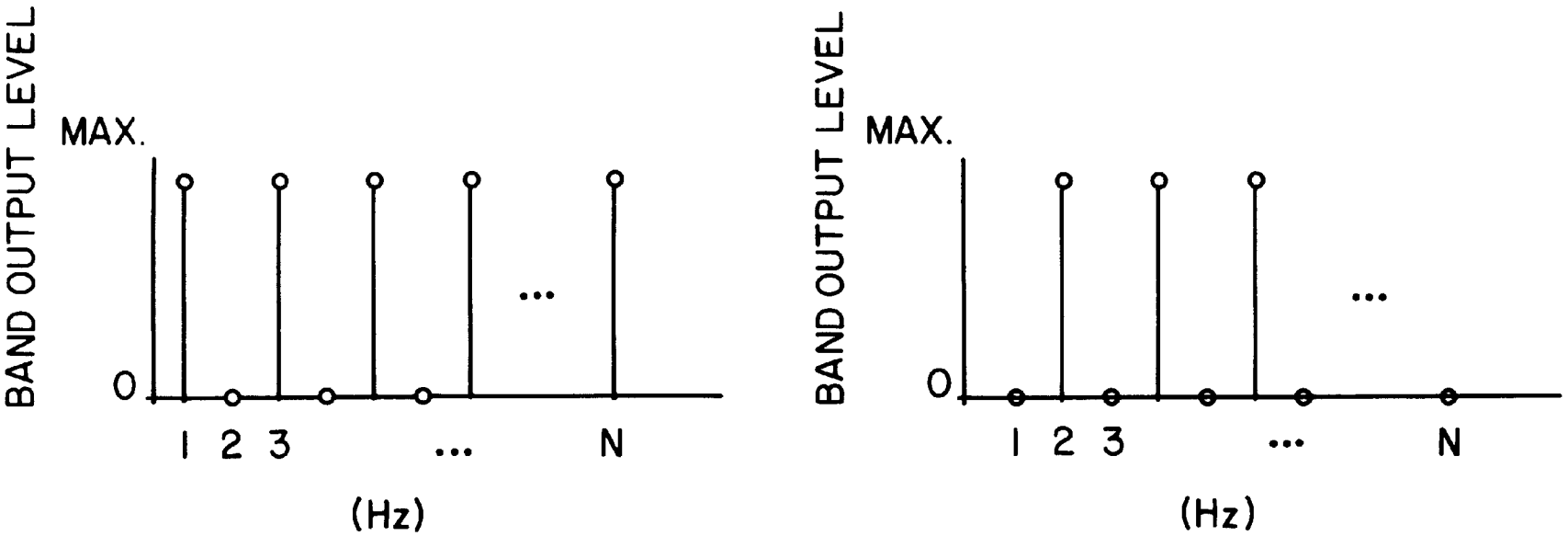
FIG. 2 shows a possible encoding scheme according to the present invention.

With reference to FIG. 2, this shows one scheme for encoding the signal. The filter bands are identified as alternating even numbered bands and odd numbered bands. As shown, logic level 0 could be represented by providing a signal in the odd numbered bands with no signal substantial (e.g. the signal is below a threshold level) in the alternating even numbered bands. Correspondingly, logic level 1 could be identified by a signal in the even numbered bands with no substantial signal in the odd numbered bands.

How the bands are used to carry the signal format, will depend upon how many bands are present in the filterbank structure. For example, it is envisaged that the number of bands could vary between 16 and 128. For 128 bands, it is not necessary to have this alternating signal format over all the 128 bands. It is simply necessary to cover a sufficient number of bands so that the digitally encoded program data is clearly distinguishable from any ambient or local signal that might be received.

It will also be appreciated that while simple logic levels 1 and 0 can be identified in the manner indicated, other more complex encoding schemes can be provided, so as to enable more rapid transmission of data. For example, where there are 128 bands, each group of 16 bands, or possibly even a smaller number of bands, could be used to encode 1 bit of data. This would enable 8 bits of data or more to be transmitted simultaneously.

It is also possible that more complex encoding schemes could be used. Indeed, it is anticipated that any conventional encoding scheme, as used for conventional modems and transmission over telephone lines could be used. In fact, because of greater bandwidth available here, as compared to telephone lines, such encoding schemes could be modified to give even greater data transfer rates.

Thus, for example a number of known modulation techniques for computer modem and RF applications could be used to transmit data to the digital hearing aid via an audio signal or channel. For example, a technique similar to spread spectrum, where the input data stream is modulated with an audio band and maximum length sequence could be used. This technique should be very resistant to background noise. Other, standard modulation/demodulation techniques, such as quadrature phase shift keying (PSK), differential PSK (DPSK) and quadrature amplitude modulation (QAM) could also be used. Using any of these techniques would require the hearing aid to operate as a modem. For this purpose, the programmable DSP 34 would effectively include means for demodulating and decoding the selected modulation scheme.

As many modem encoding schemes may not be readily distinguishable from potential ordinary, audio signals, to ensure accurate identification of these signals, the hearing aid would first have transmitted to it a short audio programming signal, encrypted in the manner indicated above, to signal to the hearing aid that it should switch into the programming mode. The hearing aid would then read further signals received according to the encoding scheme indicated by the initial instruction. At the end of these instructions, an end of programming instruction would be sent to the hearing aid, causing it to switch back to its ordinary mode of operation, until it again received a short, initial instruction sequence indicating that programming should commence.

The verification signal is reproduced acoustically by the hearing aid receiver at a low enough level that the hearing aid could be worn by a user while it is being programmed. For this situation, the verification signal would be transmitted to the ear canal where it would be received by a probe-tube microphone system that is connected to the hearing aid programming system. If the hearing aid is worn by a user while being programmed, the programming information is transmitted to the hearing aid over a loudspeaker in a sound field. In very noisy or reverberant environments headphones will be used to transmit the audio programming signal. This will ensure that the hearing aid receives a "clean" audio programming signal.

The hearing aid programming system is also capable of programming the hearing aid while it is not being worn. In this case, the hearing aid is placed into a sound chamber with its output connected to a coupler that approximates the acoustic characteristics of the human ear canal and provides acoustic isolation from the input channel. The hearing aid programming system transmits the programming signals through a loudspeaker to the hearing aid. The verification signal is transmitted from the hearing aid receiver into the coupler where it is amplified and sent back to the hearing aid programming system and compared against the data that was transmitted.

The audio signals that represent binary "1" and "0" may be synthesized so that they activate every other channel of the analysis filterbank at a level that is sufficient to distinguish the transmitted level from any interfacing signals that may be present. These signals are constructed from sums of sinusoids with frequencies that lie at the centre frequencies of alternate channels of the analysis filterbank.

These signals are synthesized using a software program running on a multimedia PC, by dedicated hardware located in a PC or by a hearing aid programming system and transmitted acoustically to the hearing aid. If remote programming of a hearing aid over a computer network is required, a binary or text file representation is transmitted over the network to a multimedia PC or hearing aid programming system and the programming signals are locally synthesized and transmitted acoustically to the hearing aid.

I claim:

1. A method of processing an audio band signal in a digital hearing aid, said hearing aid comprising a microphone, an analysis filterbank having a plurality of separate frequency band outputs, a programmable digital signal processor, a non-volatile memory, and a receiver, the method comprising the steps of:

(1) programming an encoding scheme in said digital signal processor;

(2) receiving said audio band signal at said microphone;

(3) converting said audio band signal into a digital signal;

(4) in said analysis filterbank, separating said digital signal into a plurality of separate frequency band signals each being representative of a specific frequency band;

(5) providing said frequency band signals to said digital signal processor;

(6) determining whether said separate frequency band signals have programming information encoded therein according to said encoding scheme; and (7) if programming information is encoded in said frequency band signals according to said encoding scheme, decoding said frequency band signals to obtain said programming information and storing said programming information in said non-volatile memory.

2. A method as claimed in claim 1 further including a step of:

(8) if programming information is not encoded in said frequency band signals according to said encoding scheme, processing said frequency band signals according to programming information stored in said hearing aid to provide a processed audio band output signal at said receiver.

3. A method as claimed in claim 1 further including a step of synthesizing programming information into an audio band programming signal and transmitting the audio band programming signal to said hearing aid.

4. A method as claimed in claim 3, wherein the programming information is encoded in the audio band programming signal in the frequency range of 20 Hz–20 kHz.

5. A method as claimed in claim 3, wherein the programming information is digitally synthesized into an audio band programming signal in a manner that distinguishes the audio band programming signal from potentially interfering audio signals.

6. A method as claimed in claim 5, wherein the programming information is synthesized into the audio band programming signal such that the frequency band signals generated by the analysis filterbank in response to said audio band programming signal are indicative of audio information being present in alternate frequency bands and of audio information being substantially absent in frequency bands between said alternate bands.

7. A method as claimed in claim 6, wherein the frequency bands comprise alternating even numbered bands and odd numbered bands, and wherein logic level one is encoded with said alternate bands being one of the even numbered bands and the odd numbered bands and logic level zero is encoded with said alternate bands being the other of the even numbered bands and the odd numbered bands.

8. A method as claimed in claim 3, wherein step (7) further comprises the step of generating an audio verification signal at said receiver to verify that programming information has been stored in the hearing aid.

9. A method as claimed in claim 8 wherein a separate microphone connected to a PC-based or dedicated hearing aid programmer is provided for receiving the audio verification signal, to verify the correctness of the programming information stored in the hearing aid.

10. A method as claimed in claim 3, wherein the audio band programing signal is transmitted over a network, selected from one of a local area network, a wide area network or a modem link, the method including the steps of synthesizing programming information into the audio band programming signal locally and acoustically transmitting the audio band programming signal to the hearing aid.

11. A method as claimed in claim 10, wherein the programming information is received by a multimedia computer in a text format or a binary format and synthesized locally into the audio band signal.

12. A method as claimed in claim 3, wherein the audio band programming signal is pre-synthesized by a computer and transmitted over a computer network to a hearing aid program system, where the programming information is decoded and acoustically reproduced for programming the hearing aid.

13. A method as claimed in claim 1, wherein the encoding scheme is based on one of the following:

phase shift keying (PSK), differential phase shift keying (DPSK), quadrature amplitude modulation (QAM), or a spread spectrum technique.

14. A method as claimed in claim 3 or 13, wherein steps (2) to (7) are carried out either:

with the hearing aid worn by a user to enable immediate verification of the suitability of the program for the user; or by placing the hearing aid in a sound chamber and connecting the hearing aid to a coupler simulating the characteristics of the human ear canal, whereby the programming signal can be transmitted acoustically to the hearing aid, isolated from any interfering audio signal.

15. A method as claimed in claim 14, wherein the hearing aid includes first and second inputs, said first input comprising the microphone, and the method comprises encoding the programming information into two separate audio band signals and transmitting one audio band signal to one input and the other audio band signal to the other input.

16. A digital hearing aid comprising:

(a) a microphone for receiving an audio band signal;

(b) an A/D converter for converting said audio band signal into a digital signal;

(c) an analysis filterbank for separating said digital signal into a plurality of separate frequency band signals each being representative of a specific frequency band;

(d) a programmable digital signal processor for receiving said frequency band signals and being programmed to determine whether said separate frequency band signals have programming information encoded therein according to an encoding scheme;

(e) a non-volatile memory for storing programming information, wherein, when programming information is encoded in said frequency band signals, said digital signal processor decodes said frequency band signals and stores said programming information in said memory;

(f) a synthesis filterbank for combining said processed frequency band signals into a processed digital signal; and (g) a D/A converter and receiver for converting said processed digital signal into a processed audio band output signal.

17. A hearing aid as claimed in claim 16 wherein, when programming information is not encoded in said frequency band signals, said digital signal processor processes said frequency band signals according to programming information stored in said memory to provide processed frequency band signals.

18. A hearing aid as claimed in claim 16, wherein the programmable digital signal processor is programmed to identify programming information when audio information is present in alternate frequency bands and substantially absent in frequency bands between said alternate bands.

19. A digital hearing aid as claimed in claim 16, wherein the programmable digital signal processor is programmed to decode and demodulate programming information transmitted in an audio band programming signal according to the encoding scheme, said encoding scheme being based on one of the following:

phase shift keying (PSK), differential phase shift keying (DPSK), quadrature amplitude modulation (QAM), or a spread spectrum technique.

20. A digital hearing aid as claimed in claim 16 having first and second inputs, said first input comprising the microphone, and whereby the programmable digital signal processor can receive programming information through both inputs.

21. A hearing aid programming system comprising a digital hearing aid as claimed in claim 16 and a PC-based or dedicated hearing aid programmer which synthesizes programming information into an audio band programming signal and transmits the audio band programming signal to said hearing aid.

22. A hearing aid programming system as claimed in claim 21 wherein said digital signal processor is further programmed to generate an audio verification signal at said receiver to verify that programming information has been stored in said memory.

23. A hearing aid programming system as claimed in claim 21 wherein said PC-based or dedicated hearing aid programmer includes a separate microphone for receiving the audio verification signal to verify the correctness of the programming information stored in the hearing aid.

* * * * *